United States Patent [19]

Kraayvanger

[11] 4,209,928

[45] Jul. 1, 1980

[54] DISPLAY DEVICE

[75] Inventor: Allan G. Kraayvanger, Mundelein, Ill.

[73] Assignee: Perrigraphics, Inc., Waukesha, Wis.

[21] Appl. No.: 918,402

[22] Filed: Jun. 23, 1978

[51] Int. Cl.[2] ..... G09F 7/18

[52] U.S. Cl. ..... 40/610; 40/607; 40/617

[58] Field of Search ..... 40/607, 606, 617, 613, 40/539, 124.1, 152.1, 610

[56] References Cited

U.S. PATENT DOCUMENTS

| | | | |
|---|---|---|---|
| D. 142,675 | 10/1945 | Sherr | 40/152.1 X |
| 954,288 | 4/1910 | Holloway | 40/613 X |
| 2,032,561 | 3/1936 | Buehler | 40/617 |
| 3,015,899 | 1/1962 | Ensign et al. | 40/124.1 X |
| 3,123,207 | 3/1964 | Goldstein | 40/124.1 X |

*Primary Examiner*—John F. Pitrelli

*Attorney, Agent, or Firm*—Gary, Juettner & Pyle

[57] ABSTRACT

A display device is formed from flexible sheet material and allows one or a plurality of signs to be supported from a common core support. The core support comprises a single sheet having a number of slits at one end that define arms. The support is folded such that the arms extend at angles from each other. The arms are secured around the signs to provide a multi-face display or sign.

6 Claims, 12 Drawing Figures

DISPLAY DEVICE

BACKGROUND OF THE INVENTION

The present invention relates to a sign or display device suitable for providing a three dimensional construction from easily fabricated pieces of flexible sheet material.

Although it is well known to suspend signs, displays or other objects from a support, these devices are usually complicated in their construction, require a large number of parts, some of which are usually heavy or rigid, and are generally difficult to assemble. Accordingly, it would be desirable to provide a display device that may be easily constructed from standard flexible sheet materials such as paper or fiberboard. Also, it would be desirable to provide such a display that may be easily attached or affixed to a support, as well as a display having provision for a number of signs facing at different angles such that the display has maximum eye appeal and visibility.

SUMMARY OF THE INVENTION

The display device of the present invention comprises at least one sign that is secured to a support of flexible sheet material. The support may comprise a multiple sided core made from folded sheet material together with a plurality of individual arms extending from each side of the core. Signs are secured between the arms and the core by wrapping the arms around the top portions of the signs and providing means to secure the signs to the arms and/or the core. The display may have one or a plurality of signs secured from their respective arms at angles to each other, thus providing a multi-faceted sign arrangement around the common axis of the core.

Since only flexible sheet material is used in the construction of the display device, the device is inexpensive to fabricate by simply slitting, cutting and folding sheet material to the proper configuration. In addition, the display device may be easily assembled from the sheet material components, thus facilitating the transport of the display to the location of use. Furthermore, the display of the present invention provides a means to uniquely present signs containing highly visual information from any viewing position around the display, thus providing for maximum effectiveness at minimal cost.

DESCRIPTION OF THE PREFERRED EMBODIMENTS

Figure 1:
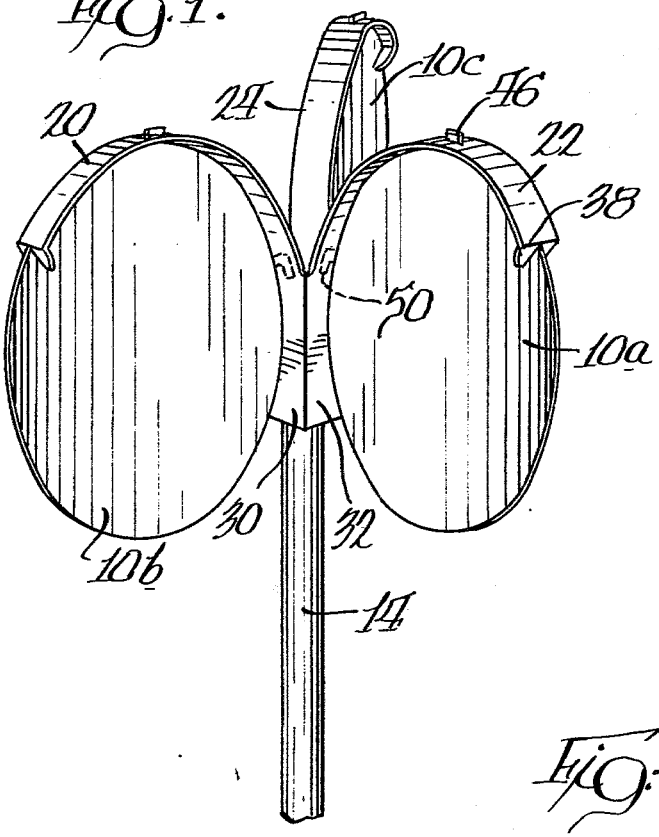
FIG. 1 is a perspective view of one embodiment of the display of the present invention.
Figure 2:
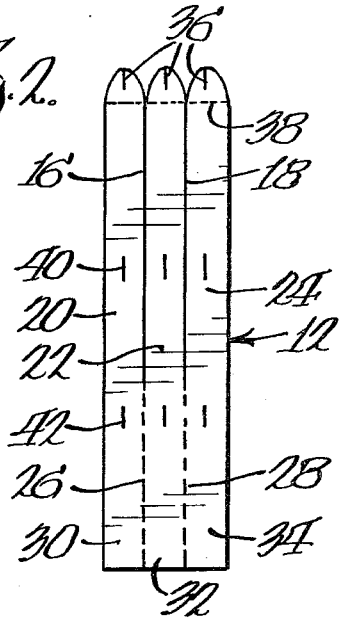
FIG. 2 is a plan view of the base or core portion of the display shown in FIG. 1.
Figure 3:
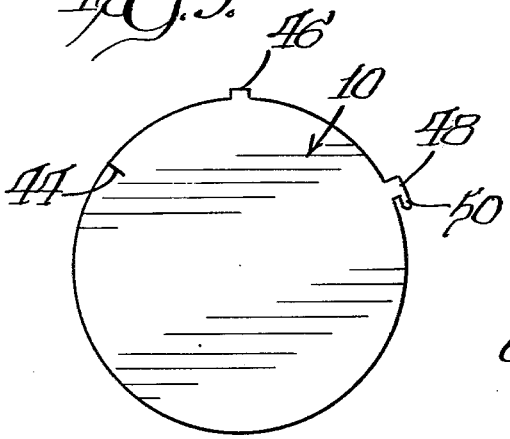
FIG. 3 is a plan view of one of the signs utilized in the FIG. 1 embodiment.

With reference first to FIGS. 1, 2 and 3, it may be observed that the display is made up from two basic components, namely, one or more signs, generally indicated at 10, and a base or core 12 for supporting the signs and adapted to be suspended from or supported upon a suitable support, such as a post 14. In the present embodiment, the core 12 is constructed to support three individual signs, designated in FIG. 1 as 10*a*, 10*b* and 10*c*.

As shown in FIG. 2, the core 12 is fabricated from a flat piece of any suitable sheet material which is sufficiently sturdy to support the signs 10. Without way of limitation, suitable sheet materials, for example, would include cardboard or fiberboard, heavy paper, plastic sheeting, laminated sheeting and the like. The signs 10 are also composed of flat sheet material, and preferably the opposed sides of each sign has a surface that may be printed with information, advertisements, or other desired visual material.

The sheet material for the core 12 is generally rectangular in shape as shown in FIG. 2. This rectangular sheet is cut, grooved or slitted from one end along lines 16 and 18, said lines being generally parallel to each other and to opposite sides of the rectangular sheet. The slits 16 and 18 extend from their point of entry at one end of the sheet toward the opposite end but terminate intermediate said ends, with the slitted end having a plurality of individual, contiguous or adjacent strips or arms 20, 22 and 24, and the other end, beyond the slits, is continuous and uncut. The continuous end, however, is folded along fold or score lines 26 and 28 that generally coincide with the respective lines of the slits 16 and 18.

The core 12 is then formed by folding the continuous portion along the fold lines 26 and 28 until the opposite sides meet. In the case of the present embodiment, the resultant structure would have a triangular shape with three sides 30, 32 and 34. Suitable means, such as tape, adhesive, or other fastening means (not shown) are provided to fasten or secure the opposite side edges of the folded continuous portion in such a manner to provide a multi-sided body having the separate arms 20,22 and 24 extending therefrom.

Each of the arms 20, 22 and 24 may have a short terminal slit 36 therein substantially parallel to the main slits 16 and 16, and the free ends of the arms may be tapered toward the slits 36. Also, fold lines 38 are provided across the arms (generally perpendicular to the slits 36), which together with the slits 36, provide a tab means for securing the ends of the arms to the signs 10. In addition, each of the arms may have one or more slots such as 40 and 42 therein for providing additional securement means to the signs 10 as will be hereinafter more fully explained. Preferably, one set of slots 40 is provided in the arms 20–24 and the other slots 42 are provided in the continous portion, said slots 40 and 42 preferably being arranged in parallel with the main slits 16 and 18 and along the same lines of the respective terminal slits 36.

As shown in FIG. 3, the signs 10 of the presently described embodiment are circular in shape and have securement means on the outer circumference thereof corresponding to and engageable with the sign securement means on the base 12. Thus, the securement means on the sign may comprise a slot 44 engageable with the tab or terminal slotted portion of the legs, a tab 46 engageable with the upper slots 40 and a locking tab 48 having a leg 50 for engaging in the slot 42.

The assembled display is shown in FIG. 1. The continuous portion of the core 12 upon being folded and secured as a triangle, is typically disposed to face downwardly, with the arms 20–24 extending thereabove. It may be thus visualized that if the ends of the arms are bend or arched downwardly, they will radiate from the core at angles of approximately 120 degrees from each other, assuming that the core is an equilateral triangle. Obviously, the angle of radiation can be varied by changing the angles at the fold lines 26 and 28.

As shown, the three arms 20–24 are used to support three of the signs 10*a*, 10*b* and 10*c*, with the plane of the signs being generally perpendicular to the plane of the arms. The arms are preferably formed to embrace or at least partially engage a portion of the upper circumference of the sign. The slotted ends of the arms are bent over and are engaged with the slots 44 of the signs in a secure locking relationship. The tab 46 engages the slot 40, and the locking tab 48 engages the slot 42 to complete the assembly.

The triangular hollow portion of the core also provides a convenient means for mounting the display assembly on a vertical support, such as the post 14 shown in FIG. 1.

When constructed as aforesaid, the arrangement and cooperatives of the various parts of the assembly provides a very sturdy construction that would not be expected from the use of flexible materials. Obviously, the locking slots 36 and 44 and the slot and tab 42 and 48 generally serve to provide vertical support for the signs 10, while the tab 46 and slot 40 primarily serve to prevent lateral movement of the sign relative to the arm. More importantly, however, the arm and sign interact in a mutually supportive relationship. The weight of the sign imparts a torsional or tensional force thereto, causing the arm to be placed under tension and to bear tightly against the perimeter of the sign. Thus, the rigid perimeter surface of the sign in effect is a support surface for the arm, and this support surface extends from the end of the arm to the continuous portion of the core, thus taking full advantage of the tensile strength of the material of the arm. Otherwise, the arms would droop considerably or would collapse at the juncture with the triangular portion or core.

Figure 9:
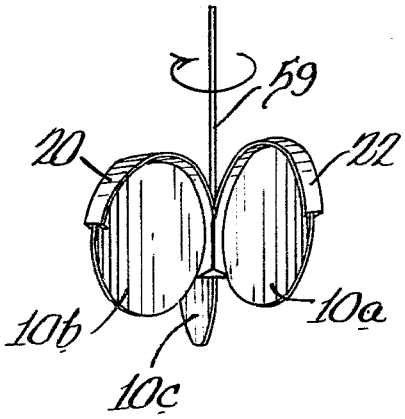

Another benefit of the present invention is that the resulting structure is always inherently symmetrical, and if the arms and signs are respectively equi-sized, the resulting display will be perfectly balanced. This feature, for example, allows the display to be rotatably suspended from a string or line 59, as shown in FIG. 9.

It will be apparent that the shape of the sign or signs need not be circular, so long as the arms may assume a shape conforming to the sign, which may include curves, straight lines and corners. For example, the display shown in FIG. 5 utilizes signs 60 having a hexogonal shape, with the arms 62 assuming and overlying the upper two edges of the sign and having a central fold 64 conforming to the engaged corner of the sign.

Figure 10:
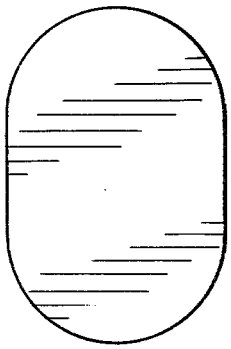
FIGS. 10, 11 and 12 are plan views of various or representative shapes of signs that may be used in connection with the display device of the present invention.
Figure 11:
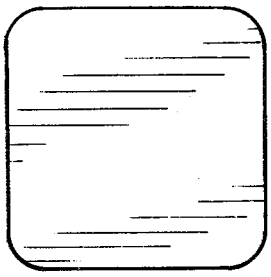
Figure 12:
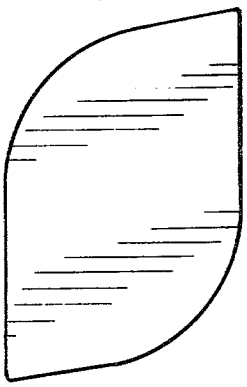

FIGS. 10, 11 and 12 illustrate various shapes of signs that may be advantageously used, although it will be apparent that virtually any shape may be employed, whether regular or irregular.

Figure 4:
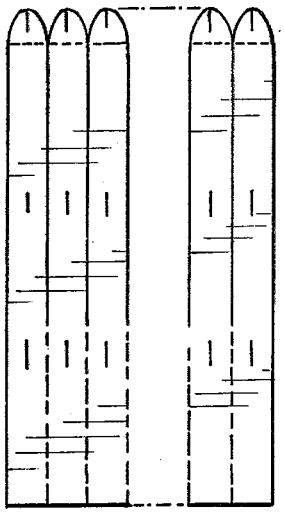
FIG. 4 is a base or core similar to that shown in FIG. 2 and further illustrating the provision of any desired number of support legs.
Figure 5:
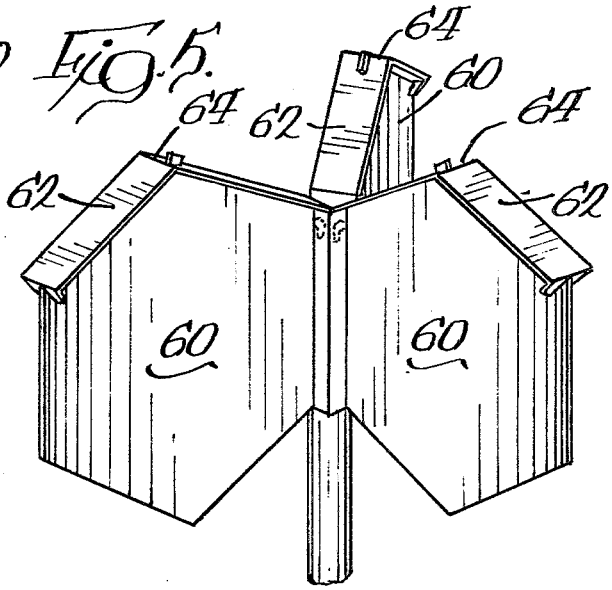
FIG. 5 is a perspective view of another embodiment of the display device of the present invention.

Although the embodiments of FIGS. 1 and 5 illustrate three sign displays, it will be apparent that the base or core may be constructed to accommodate from one to any number of signs. As shown in FIG. 4, the number of sides and arms is determined simply by selecting the proper size of sheet material and providing therein the desired number of arms and slots as previously described. The core would then be folded in the shape, for example, of a square, rectangular, pentagon, hexagon, and so forth.

Figure 6:
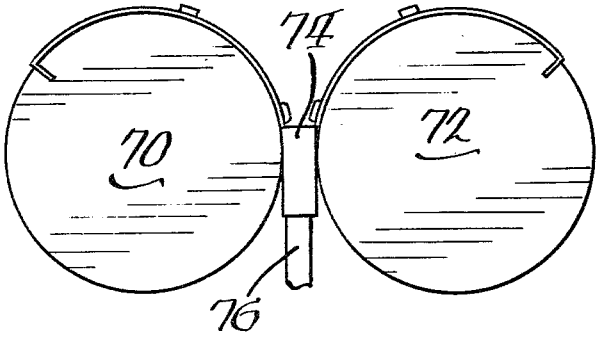
FIG. 6 is an elevational view of yet another embodiment of the display device of the present invention.
Figure 7:
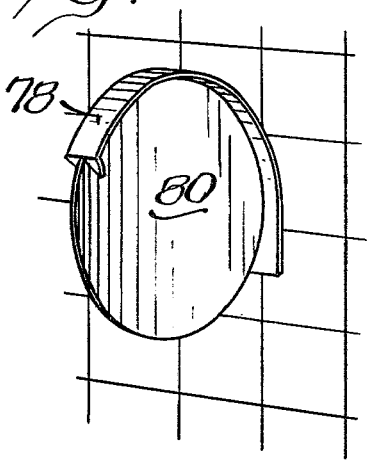
FIGS. 7, 8 and 9 are either plan or perspective views of even further embodiments of the display device of the present invention.
Figure 8:
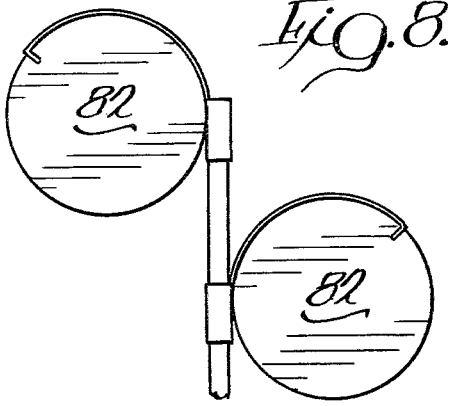

As shown in FIGS. 6, 7, 8 and 9, many variations of the display of the present invention are possible. FIG. 6, for example, illustrates a pair of signs 70 and 72 mounted side by side from a single base 74 and support post 76. FIG. 7 illustrates the use of an arm and support made from a single strip 78 to support a single sing 80, with the base of the strip being secured to a wall. FIG. 8 illustrates the possibility of mounting more than one display on a single vertical support such that the signs 82 are vertically spaced, and, moreover, these signs may also be disposed at different angles from the support.

Although the foregoing is intended as a detailed description of the preferred embodiments of the present invention, it will be apparent that numerous variations, alterations and modifications may be made without departing from the scope of the appended claims.

I claim:

1. A display device made up from pieces of flexible material, said device comprising at least one sign having a perimeter and support means for said sign, said sign support means comprising a base, a strip of material secured from said base and having a free end arching around a portion of the sign, said strip and perimeter being in substantial contact throughout the extent of said strip from said base to said free end, means for securing said sign and strip near said free end, and means for securing said sign near said base, such that the sign and the strip interact in a mutually supportive relationship.

2. The display device of claim 1 wherein said sign support means comprises a plurality of parallel strips extending from said base, said base being folded along lines parallel with said strips to form a multi-sided core having said strips radiating therefrom at angles to each other for supporting a corresponding plurality of signs.

3. The display device of claim 1 wherein the means for securing said sign and strip near said free end comprises a folded tab on said free end in locking engagement with said sign.

4. The display device of claim 1 wherein the means for securing said sign near said base comprises a tab on said sign engaging a slot in said base.

5. The display device of claim 1 wherein the plane of said strip is perpendicular to the plane of the sign, said strip conforming to the shape of said perimeter.

6. The display device of claim 1 wherein a plurality of said devices are supported on a common vertical support.

* * * * *